United States Patent [19]

Folta et al.

[11] 4,393,683

[45] Jul. 19, 1983

[54] TRACTION DRIVE FOR FORGING MANIPULATORS

[75] Inventors: Werner Folta, Mettmann; Erwin Kost, Meerbusch, both of Fed. Rep. of Germany

[73] Assignee: SMS Schloemann-Siemag Aktiengesellschaft, Dusseldorf, Fed. Rep. of Germany

[21] Appl. No.: 267,701

[22] Filed: May 27, 1981

[30] Foreign Application Priority Data

Jun. 7, 1980 [DE] Fed. Rep. of Germany ..... 3021519

[51] Int. Cl.[3] ..... B21J 13/10

[52] U.S. Cl. ..... 72/422; 105/29 R

[58] Field of Search ..... 72/420, 422; 105/29 R

[56] References Cited

U.S. PATENT DOCUMENTS

| | | | |
|---|---|---|---|
| 862,080 | 7/1907 | Levin | 105/29 R |
| 1,027,078 | 5/1912 | Sessions | 105/29 R |
| 3,129,616 | 4/1964 | Bell, Jr. | 72/420 |
| 3,349,601 | 10/1967 | Burrows | 72/420 |
| 3,497,089 | 2/1970 | Forster et al. | 105/29 R |
| 3,696,651 | 10/1972 | Harrison | 72/420 |

FOREIGN PATENT DOCUMENTS

| | | | |
|---|---|---|---|
| 1094329 | 12/1967 | United Kingdom | 72/422 |

*Primary Examiner*—Lowell A. Larson

*Attorney, Agent, or Firm*—Holman & Stern

[57] ABSTRACT

A forging manipulator has a traction drive with toothed wheels meshing with racks. The toothed wheels are coaxial with rail wheels supporting the manipulator and are mounted as close as possible to output shaft bearings of the drive which bearings are journalled in bearings in the chassis. Torque reaction is absorbed by members articulated to the drive transmission casing and directly or indirectly to the chassis side members.

6 Claims, 3 Drawing Figures

TRACTION DRIVE FOR FORGING MANIPULATORS

BACKGROUND OF THE INVENTION

1. Field of the Invention

This invention relates to the arrangement of a traction drive on the chassis of a rail-mounted forging manipulator.

2. Description of the Prior Art

Traction drives for forging manipulators commonly comprise one or more hydraulic motors, and a transmission, preferably mounted away from the hot region at the forward end of the chassis. Traction is effected by means of toothed wheels, for example spur gears or chain sprocket wheels, which mesh with fixed gear racks or chains acting as racks, in order to obtain precisely specified and controlled forward and rearward travel of the manipulator chassis. The chains are usually pin rack chains. Alternatively, gear racks or pin racks can be used. The racks are usually mounted close to the rails on which the chassis runs, to leave space for the long slidable forging tables of a forging press.

Two main arrangements are used for mounting the traction drives:

In one arrangement the traction drive is behind the rear wheels and is suspended from front and rear cross members disposed between side members of the chassis: see German Patent Specifications OS Nos. 2143669 and AS 1652815. In this arrangement, the cross members have to transmit the applied forces to the side members of the chassis, and must absorb additional bending forces. Access is difficult because the motor and sprocket wheel are between the side members of the chassis. The traction drive has to be removed from above, so that a superstructure cannot be provided on the rear part of the chassis. Because the racks are placed as close as possible to the rails, the output shafts, on the ends of which the sprockets or spur gears are mounted, project a considerable distance from the drive transmission casing and therefore have a substantial overhanging length. These shafts are therefore subject to unnecessary bending forces. The transmission of force through the cross members, and the length of the output shafts, leads to undesirable flexing or resilience with adverse effects on the accuracy of the travel and positioning of the forging manipulator. Another disadvantage is that the transmission casing must be designed to withstand the transmission of forces and the absorption of reaction shocks. Furthermore, if the manipulator is lifted in the region of the press, it will be supported only by the sprocket wheel or spur gear in the rack or rack chain, leading to the risk of breakage of the rack or the toothed wheel.

In the other common arrangement, the traction drive is suspended in front of the rear wheels of the chassis: see French Patent Specification No. 1445178, and the Journal "Metals and Materials", December 1978/January 1979, pages 28 to 31 and picture on page 29. The advantage of this is improved accessibility to the toothed wheel and the hydraulic motor or motors, since the cross member is above the drive on the chassis. A superstructure can be built above the drive, for example comprising oil tanks, pumps, and so on. However, there are still disadvantages. The cross member must transmit force from the transmission casing to the side members of the chassis, providing a very unfavourable force transmission path. The output shafts of the drive project substantially from the drive transmission casing and are therefore subject to bending. The transmission of force through the cross member, and the long projection of the output shaft, again allow flexing which impairs the accuracy of positioning the manipulator. Removal of the transmission casins is inconvenient because the toothed wheel must be lifted out of mesh. If the manipulator is lifted in the region of the forging press, the toothed wheels are lifted out of the racks and the chassis can then roll back on its rear rail wheels.

BRIEF SUMMARY OF THE INVENTION

An object of the present invention is to provide a mounting arrangement for the traction drive of the forging manipulator, in which the above-mentioned disadvantages are avoided, a compact construction is obtained, forces are transmitted directly, and easy access and dismantling are possible.

According to the present invention, the traction drive is hinged on the one hand to the side members of the chassis by way of its outut shaft bearings, and on the other hand by way of torque-absorbing support means provided either between the transmission casing and the side members of the chassis, or between the transmission casing and a cross member connecting the side members; the output shaft bearings are directly adjacent to the toothed wheels of the traction drive; the output shaft casing of the output shaft bearings is mounted on the side members, in bearing means; and the drive output shaft, together with the toothed wheels, is coaxial with the rear rail wheels of the chassis. Preferably, the side member bearings, in which the transmission casing is journalled, are vertically split.

In such an arrangement, because the transmission casing, and in particular its output shaft bearings, is journalled in the side members of the chassis, the traction forces are transmitted by the shortest possible distance between the toothed wheels and the chassis side members, by way of the output shaft and associated bearings. Thrust is transmitted substantially directly to the chassis side members, without diversion, and the chassis cross members need act only as spacers interconnecting the side members. This is very advantageous for the chassis of large forging manipulators, which for reasons of manufacture and transport must be produced in several parts. Because traction forces are transmitted to the side members at positions very close to the toothed wheels, the drive output shaft is substantially or entirely relieved of bending and shear forces. Similarly, the transmission casing does not have to transmit shear or bending forces.

Because traction forces are transmitted substantially directly, over a very short path, in particular involving only a very short overhung length of the output shaft, and because the chassis cross member is not involved in the force transmission and therefore is not subject to flexing, the accuracy with which the manipulator can be positioned by the traction drive is substantially improved.

Because the toothed wheels are coaxial with the rear rail wheels, if the front of the manipulator is raised by the forging press, the rear rail wheels remain in contact with the rails and the toothed drive wheels remain in mesh with the drive racks.

DESCRIPTION OF THE DRAWINGS

One embodiment of the invention will be further described with reference to the accompanying drawings, wherein.

DETAILED DESCRIPTION

Figure 1:
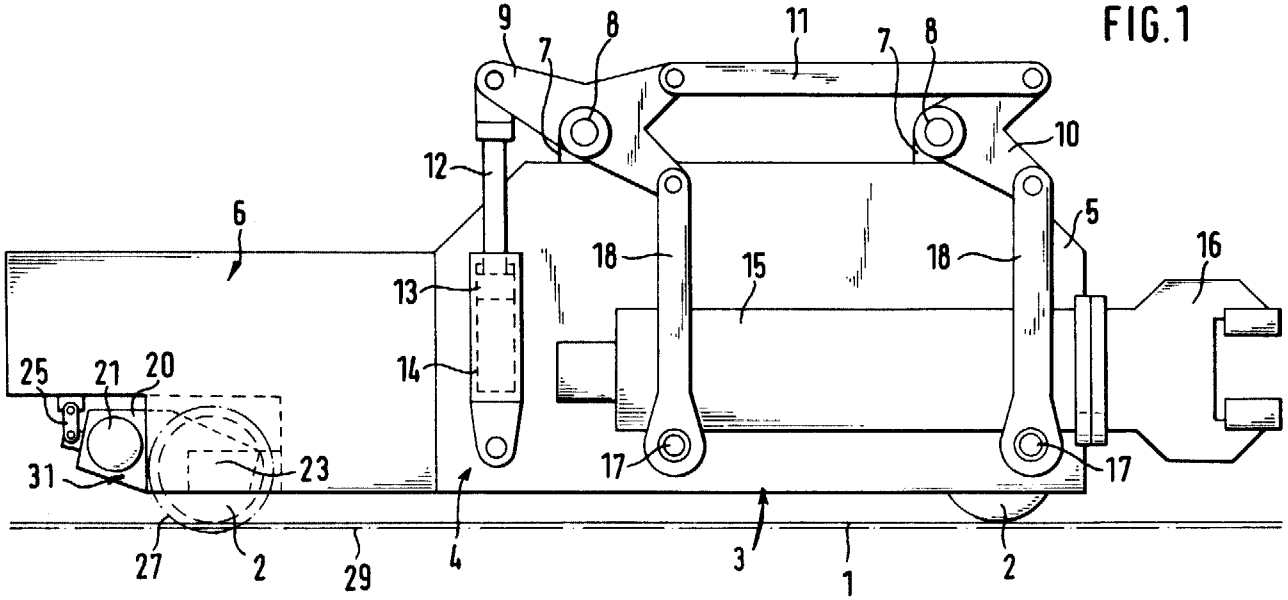
FIG. 1 is a schematic, side elevational view of a forging manipulator embodying the invention.
Figure 2:
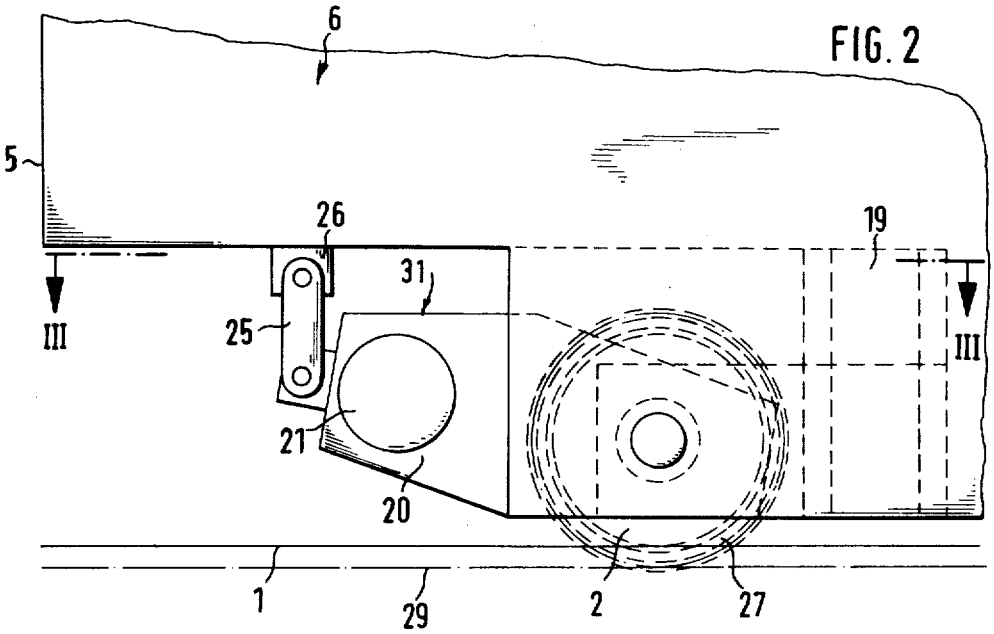
FIG. 2 is a side elevational view, on a larger scale, of the traction drive of the manipulator of FIG. 1.

The illustrated forging manipulator has a chassis 4 comprising laterally spaced side cheeks 5. In the forward region 3 of the chassis, the side cheeks carry supports 7 for cross shafts 8. On the left hand and right hand ends of the rear shaft 8 are attached bell cranks 9 with three arms. At each end of the front shaft 8 is a bell crank 10 with two arms. The front bell cranks 10 are articulated to the rear bell cranks 9 by tie rods 11 to form a parallelogram linkage. From one arm of each bell crank hangs a suspension rod 18, articulated by front and rear transverse support shafts 17 to a gripper support 15 at the front end of which is a gripper 16. The gripper support can be raised and lowered by piston rods 12 articulated to the respective third arms of the rear bell cranks 9 and attached to pistons 13 slidable in hydraulic cylinders 14 which in turn are hinged to the side cheeks 5 of the chassis. Driving means (not shown) are provided between the chassis and the gripper support 15 for moving the latter relative to the chassis in the axial or longitudinal direction.

The chassis has front and rear rail wheels 2 which run on fixed rails 1. The rail wheels have double flanges so that the chassis is positively constrained and laterally located by the rails and rail wheels.

Figure 3:
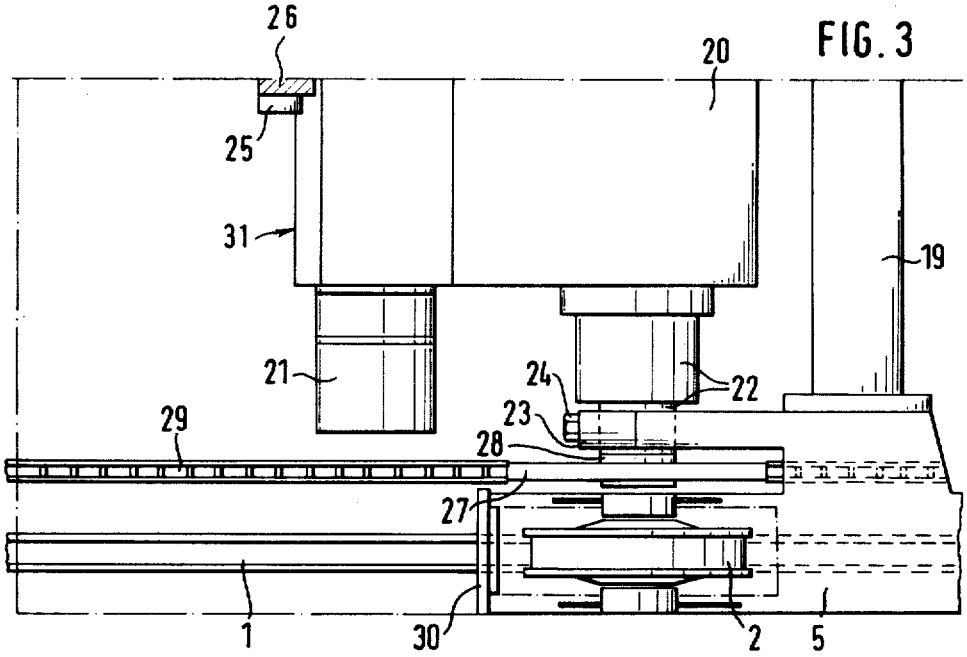
FIG. 3 is a plan view of one side of the traction drive, taken on the line III—III of FIG. 2.

In the rear part 6 of the chassis, cross members 19 interconnect the side cheeks 5 and act as spacers. The rear rail wheels 2 are mounted within the respective side cheeks 5 in spaces which are open at the rear and can be closed by detachable cover plates 30, as shown in FIG. 3.

Between the side cheeks 5 in the rear part of the chassis is suspended a drive unit 31 incorporating, on each side, sprocket wheels 27 which mesh with respective fixed pin racks or pin rack chains 29 anchored on or in the ground close beside and parallel to the rails 1.

The traction drive unit 31 comprises a transmission casing 20 with hydraulic traction motors 21 flange-mounted externally on its left and right hand sides in a horizontal plane. At the other end of the transmission casing is an output shaft 28 driven by the hydraulic motors through suitable transmission means in the casing. The transmission casing is provided with output shaft bearings 22, the external casings of which are journalled in the side cheeks 5, in vertically split bearings 23 secured by screws 24.

Each sprocket wheel 27 is mounted at a respective output shaft end directly adjacent to the output shaft bearing 22, with the suspension bearing 23 between the sprocket and the transmission casing 20. The output shaft 28 and the sprocket 27 are coaxial with the rear rail wheel 2. Furthermore, the arrangement of the shaft bearing 22 and the suspension bearing 23 is such that the transmission casing is pivotable about the common axis of the rail wheel 2, sprocket 27 and output shaft 28. The bearings 23 are provided directly on the rear ends of the side cheeks 5 of the chassis.

At the other end of the transmission casing, adjacent to the drive motors, the casing is articulated to the side cheeks of the chassis by means of torque abutments 25. These are pivoted at one end on the transmission casing, and at the other end on a rearwardly extending support arm 26 attached to the cross member 19. Alternatively, the torque abutments 25 can be directly pivoted to the side cheeks 5.

As explained above, because the sprockets and rear rail wheels are coaxial, they will remain respectively in mesh with the chain or rack and in contact with the rail, if the forging manipulator is lifted at the front by the forging press, during a forging operation.

The described arrangement enables the entire drive to be removed rearwards, because the drive unit is retained only by the vertically split bearings 23 and by the articulated suspension through the members 25. Other equipment can therefore be mounted on the rear part of the chassis.

As is best seen in FIG. 3, traction forces are transmitted from the sprocket to the side cheek of the chassis through a short and relatively direct path consisting only of a very short overhung portion of the output shaft 28, the output shaft bearing and the suspension bearing 23. Flexing of the output shaft is therefore negligible and the manipulator can be positioned very accurately by the traction drive.

We claim:

1. A forging manipulator comprising: a chassis; rail wheels rotatably mounted on said chassis for supporting the chassis so that said chassis can travel forwards and rearwards on rails, said chassis having a forward part and a rear part and forward rail wheels and rear rail wheels mounted respectively thereon; manipulating means mounted on the forward part of the chassis; laterally spaced side members on the rear part of said chassis; and a chassis drive unit mounted on the rear part of the chassis comprising, a transmission casing, a traction motor mounted on said casing, an output shaft extending from the transmission casing, bearing means for rotatably supporting said shaft on said casing, transmission means in said casing operably connecting said motor to said output shaft, a toothed wheel on said output shaft mounted directly adjacent said shaft bearing means for meshing with a stationary rack for moving said manipulator chassis along said rack and rails by said motor, said toothed wheel and output shaft being coaxial with respect to said rear rail wheels, transmission casing bearing means mounted on said side members in which the output shaft bearing means are journalled, and torque-absorbing means connecting said transmission casing to the rear part of the chassis.

2. A manipulator as claimed in claim 1 in which said torque-absorbing means connect said casing directly to said side members.

3. A manipulator as claimed in claim 1 and further comprising a cross-member interconnecting said side members, and wherein said torque-absorbing means connects said casing directly to said cross-member.

4. A manipulator as claimed in claim 1, 2, 3, or 6 wherein said drive unit comprises two said toothed wheels disposed one on each side of said transmission casing.

5. A manipulator as claimed in claim 1, 2, 3, or 6 wherein said transmission casing bearing means comprise split bearings divided about a substantially vertical plane.

6. A forging manipulator comprising: a chassis; rail wheels rotatably mounted on said chassis for supporting the chassis so that said chassis can travel forwards and rearwards on rails, said chassis having a forward part and a rear part and forward rail wheels and rear rail wheels mounted respectively thereon; manipulating means mounted on the forward part of the chassis; laterally spaced side members on the rear part of said chassis; and a chassis drive unit pivotably suspended on the rear part of said chassis substantially rearwardly of the rear rail wheels comprising a transmission casing, a traction motor mounted on said casing rearwardly of said rear rail wheels, an output shaft extending from the transmission casing at the forward end thereof, transmission means in said casing operably connecting said motor to said shaft, bearing means for rotatably supporting said shaft on said casing, a toothed wheel on said output shaft mounted directly adjacent said shaft bearing means for meshing with a stationary rack for moving said manipulator chassis along said rack and rails by said motor, said toothed wheel and output shaft being coaxial with respect to said rear rail wheels, transmission casing bearing means mounted directly on said side members in which the output shaft bearing means are journalled, and torque-absorbing means connecting the rear part of said casing to the rear part of the chassis.

* * * * *